US006942526B2

(12) United States Patent
Wirth

(10) Patent No.: US 6,942,526 B2
(45) Date of Patent: Sep. 13, 2005

(54) TOOL-LESS TERMINAL CONNECTOR FOR SIDE MOUNT-TYPE BATTERY

(75) Inventor: Steven E. Wirth, Bloomington, MN (US)

(73) Assignee: Wirthco Engineering INC, Bloomington, MN (US)

( * ) Notice: Subject to any disclaimer, the term of this patent is extended or adjusted under 35 U.S.C. 154(b) by 0 days.

(21) Appl. No.: 10/703,904

(22) Filed: Nov. 7, 2003

(65) Prior Publication Data

US 2005/0101197 A1 May 12, 2005

(51) Int. Cl.[7] ..... H01R 4/30

(52) U.S. Cl. ..... 439/755

(58) Field of Search ..... 439/755, 765, 439/771, 801, 810, 883

(56) References Cited

U.S. PATENT DOCUMENTS

| | | | | |
|---|---|---|---|---|
| 4,673,240 A | | 6/1987 | Byfield, Jr. | |
| 4,691,980 A | * | 9/1987 | Sandor | 439/476.1 |
| D397,091 S | | 8/1998 | Wirth | |
| 6,364,585 B1 | * | 4/2002 | Sakamoto | 411/7 |
| 6,394,724 B1 | * | 5/2002 | Kelly et al. | 411/353 |

* cited by examiner

*Primary Examiner*—Phuong Dinh
(74) *Attorney, Agent, or Firm*—Roger W. Jensen

(57) ABSTRACT

A tool-less, side mount-type battery terminal connector comprises an elongated conductive body having threads on the inner end sized to engage a threaded female recessed battery terminal, a central cylindrical portion of larger diameter than the inner end, and knob on the outer end. A shoulder at the junction of the inner end and the central cylindrical portion functions to clamp an end terminal of an electrical cable to the battery terminal. The knob is sized to facilitate manual, tool-less rotation of the body.

1 Claim, 2 Drawing Sheets

FIG. 7
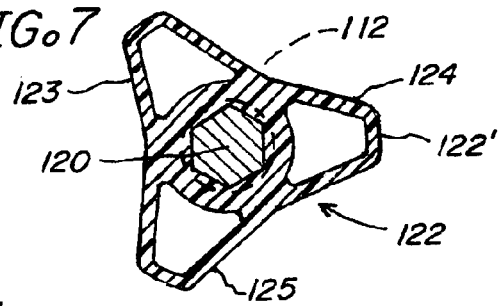
FIG. 4
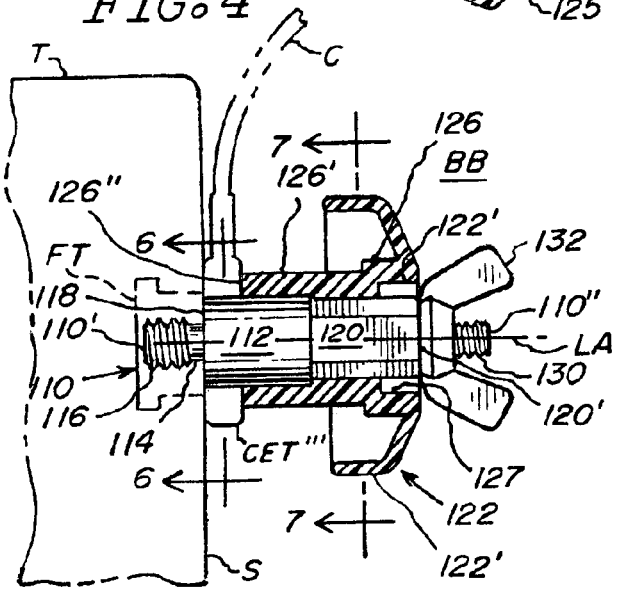
FIG. 5
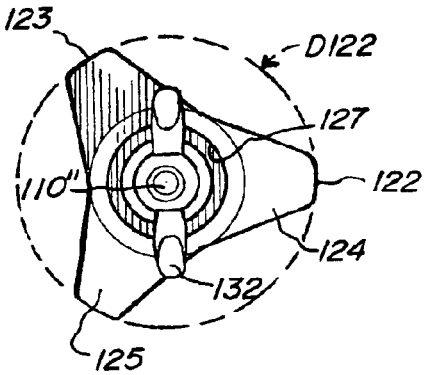
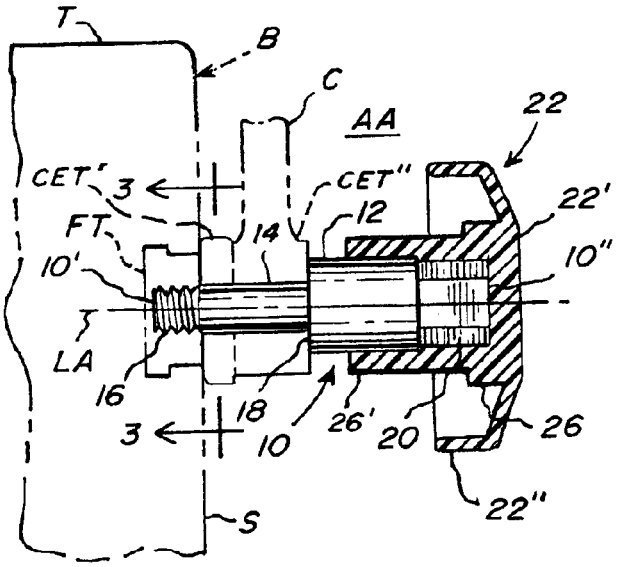
FIG. 1
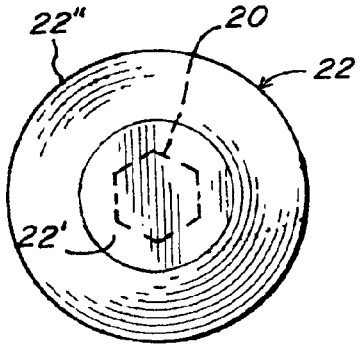
FIG. 2

TOOL-LESS TERMINAL CONNECTOR FOR SIDE MOUNT-TYPE BATTERY

BACKGROUND OF THE INVENTION

This invention is specifically directed to battery terminal connectors for side-mount type batteries, i.e., batteries having terminals in the sides thereof to which are connected one or more cables for conducting electric current. In the motor vehicle and marine field (automobiles, boats, busses, tractors and trucks) the early batteries for use in engine starting and other electrical loads were the "top mount" type, i.e., the terminals were (i) on the top of the battery, (ii) "male", i.e., projecting upwardly from the top, and (iii) usually relatively accessible and visible for the connection and disconnection of the cables thereto.

In more recent times, a significant number of batteries are of the "side-mount" type and are widely used in the motor vehicle and other fields. The side mount-type battery terminals have a flat exposed face co-planar with the side of the battery and have a central threaded "female" bore adapted to receive a threaded "male" connector. While side mount-type batteries have certain advantages, they have significant disadvantages, at least for some applications. More specifically, it is frequently logistically difficult to connect or disconnect cables to a side mount-type battery. Tools such as a box wrench are used to rotate the threaded connector to either clamp or loosen the cable end terminal to the battery side terminal. Often it is difficult for the mechanic to observe or easily reach the connector. Further, it is often difficult to rotate a wrench more than a few degrees, and, at best the process is relatively slow. A specific example of a prior art connector for a side-mount type battery is U.S. Pat. No. 4,673,240 teaching a threaded bolt 15 having wrench engaging surfaces 16. The arrangement shown in this patent is that which is subject to the above noted disadvantages. There are a plurality of prior art "stand-offs" connectors requiring the use of a wrench or other tool for utilization; these also are subject to the above noted disadvantages.

SUMMARY OF THE INVENTION

My invention provides a tool-less, side mount-type battery terminal connector for use with the combination of a battery with a threaded female terminal in a side thereof and at least one cable end terminal to be electrically connected to the threaded female battery terminal, my terminal connector providing a quick connection or disconnection of the cable end terminal to or from the threaded female battery terminal.

My battery terminal connector comprises an elongated body of conductive metal such as brass and having a longitudinal axis, an inner end, an outer end and a central cylindrical portion having a pre-selected diameter. The inner end has a reduced diameter as compared to the pre-selected diameter of the central cylindrical portion, such reduced diameter being selected so that the inner end, with suitable threads, may be threaded into a threaded female terminal. A radially extending shoulder is defined between the inner end and the central cylindrical portion.

The elongated metal body may include non-uniform radially extending means on the outer end thereof, an example of such means being a poly-sided configuration.

A knob means, preferably of suitable molded plastic, is connected to the outer end of the metal body, surrounding the aforesaid non-uniform radially extending means. The knob is sized for comfortable gripping by a hand to either connect or disconnect cables to the battery. The knobs may have a round radial periphery or other configuration such as a triangular shape. The knob also may include a radially extending shoulder spaced longitudinally outward from the shoulder on the conductive body.

An alternate embodiment of the invention provides an auxiliary axial conductive, threaded extension of the conductive body which projects outward from the knob and which may serve as a male terminal to which additional cables may be attached.

DESCRIPTION OF THE DRAWING

FIG. 1 is a side view, partly in section, of one of the preferred embodiments of a terminal connector provided by my invention:

FIG. 2 is a knob-end view of the connector shown in FIG. 1;

FIG. 4 is a side view, partly in section, of another of the preferred embodiments of a terminal connector provided by my invention;

FIG. 5 is a knob-end view of the connector shown in FIG. 4;

FIG. 7 is a sectional view of the connector of FIG. 4 as viewed along section lines 7—7 of FIG. 4.

DETAILED DESCRIPTION OF THE INVENTION

Figure 8:
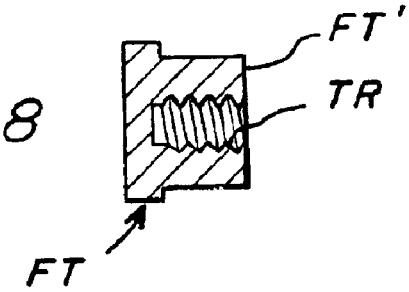
FIG. 8 is a cross-sectional view of a female or recessed terminal of the type used in side mount-type batteries.

FIG. 1 depicts a side mount-type battery B having a top T, a side S and a recessed or female terminal FT; this type of battery is currently widely used for many applications. The terminal FT is also shown in FIG. 8 as having a threaded recess TR which has a longitudinal axis LA shown in FIG. 1; terminal FT also has an axial conductive end surface FT'.

One of the preferred embodiments of this invention is the tool-less terminal connector AA shown in FIG. 1; the connector comprises an elongated body 10 of electrically conductive metal such as brass. The body 10 has a longitudinal axis an inner end 10', an outer end 10" and a central cylindrical portion 12 having a pre-selected diameter. The body 10 further includes another cylindrical portion 14 of lesser diameter than that of portion 12 and which extends from portion 12 to the inner end 10' of the body. The left end of portion 14 (as shown in FIG. 1) has thread means 16 sized to match the threads of the recess TR of the female terminal FT (also as is shown in FIG. 1 where the connector AA is depicted screwed into the female terminal FT of the battery B).

The body 10 has a radially extending shoulder 18 at the junction of portions 12 and 14; shoulder 18 functions, in use, to mechanically clamp and to electrically connect cable end terminals to the female terminal FT as will be discussed in greater detail below.

The body further includes, outward from portion 12, integral, non-uniform radially extending means 20 which terminates at outer end 10", the specific means depicted being a hex or six-sided configuration (see also FIG. 2).

A knob means 22 is attached to the body 10 as is shown in FIG. 1. The knob 22 is preferably an integral, non-conductive molded plastic unit having a central hub portion 26 and an inwardly extending annular portion 26' which collectively enclose the outer end 10" of the body 10, the exterior of the radially extending means 20 (to thus provide enhanced torque transmitting capability), and a portion of the axial extent of the central cylindrical portion 12. The outer central surface of knob 22 is a flat, generally circular area 22' from which the outer surface slopes away to a circular periphery 22" having a pre-selected diameter (see FIG. 2) substantially larger than that of the central cylindrical portion 12 of body 10.

Figure 3:
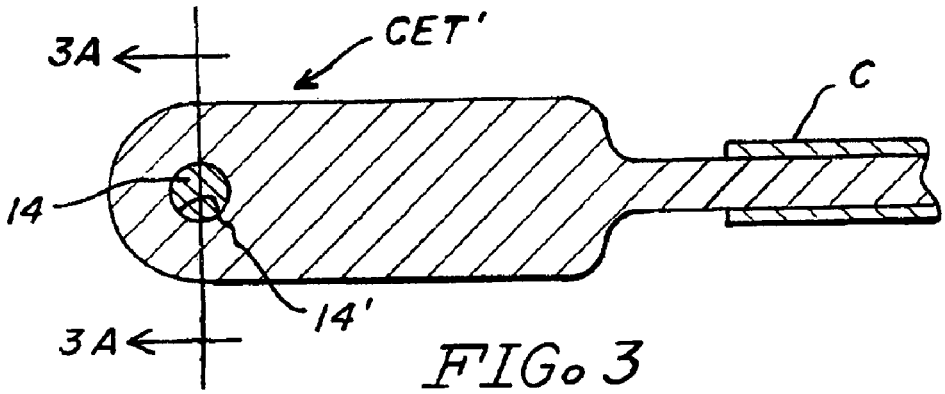
FIG. 3 is a cross-sectional view of a cable end terminal as viewed along section lines 3—3 of FIG. 1.
Figure 3A:
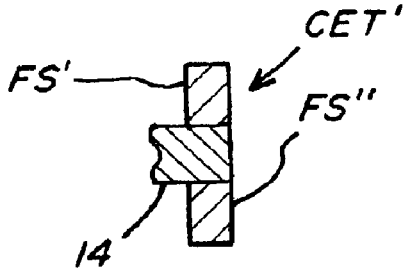
FIG. 3A is a cross section of the cable end terminal as viewed along section lines 3A—3A of FIG. 3.
Figure 6:
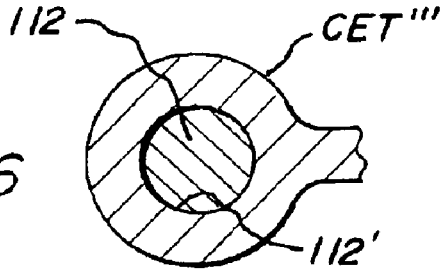
FIG. 6 is a cross-sectional view of a cable end terminal as viewed along section lines 6—6 of FIG. 5.

The connector AA can be used for attaching one or more cable end terminals of cables C to the battery; FIG. 1 shows two cable end terminals CET' and CET" so attached. More specifically, cable end terminal CET' has two flat sides FS' and FS" and a bore 14' as shown in FIGS. 3 and 3A and cable end terminal CET" has similar flat sides and a bore. Some cable end terminals have one or both sides which are other than flat, e.g., uneven. The bores in the end of the cable end terminals are sized to receive the cylindrical portion 14 of the body 10. In use, portion 14 of the body 10 is inserted through the bores of the cable end terminals and is then screwed into female terminal FT. As shown in FIG. 1, after the threads 16 on the end of portion 14 are sufficiently within the threaded recess TR of the battery female terminal FT, the cable end terminals CET' and CET" are clamped between the shoulder 18 of the body 10 and the end face FT' of the terminal FT. The aforesaid clamping assures both excellent electrical current conductivity connections between the battery and the cable end terminals as well as reliable mechanical affixing of the cables to the battery.

Another preferred embodiment of the invention is BB depicted in FIGS. 4–7; it has several similarities to connector AA of FIGS. 1–3 while having some important differences. Again, an elongated conductive body 110 has an inner end 110', an outer end 110", a central cylindrical portion 112, and a non-uniform radially extending portion 120. A relatively short axial portion 114 of the body of reduced diameter as compared to the pre-selected diameter of the portion 112 has at the end thereof thread means 116 sized to mate with the threads of the female terminal FT. At the "inboard" end of portion 112 is a shoulder 118 radially extending from portion 114. A reduced diameter threaded extension 130, integral with body 110, projects outwardly from portion 120 and the outer end thereof is the outer end 110' of body 110.

A knob means 122 is attached to the body 110 and has significant differences as compared to knob 22. It is somewhat annular in form in that it has a central recessed opening 127 at the outboard end thereof as shown in FIG. 4, leaving exposed the outboard axial end 120' of portion 120 of body 110. The knob 122 further includes a central annular hub 126 having an inwardly extending annular portion 126' terminating with a shoulder 126".

The knob means includes three radially extending portions or tabs 123, 124 and 125 equi-angularly located about the longitudinal axis of the body 110; said tabs have a radial extent pre-selected so that the outer radial extremities 122' thereof define a circle D122 as shown in FIG. 5. Note in FIG. 7 that knob 122 engages all six sides of portion 120 of body 110.

It will be understood, that although the knobs 22 and 122 are preferred embodiments of the invention, other knob configurations available and the claims herein are intended to cover all such variations of the invention.

The relative axial positions of shoulders 118 and 126" as well as the axial length of the portion 114 of the body are pre-selected so as to facilitate the clamping of a cable end terminal CET'" as is depicted in FIG. 4. Note in FIGS. 4 and 6 that CET'" has a bore sized to receive the central cylindrical portion 112 of the body 110. Note further that when portion 114 of body 110 is fully engaged with the threaded recess TR of the female terminal FT, then (a) the axial face 118 of portion 112 abuts and is in electrical contact with the axial face FT' of the female terminal FT, and (b) the axially facing shoulder 126" of knob 122 abuts and clamps CET'" against the axial face FT' of the female terminal FT. Thus the connector provides excellent electrical current conductivity between the female terminal FT and CET'". Portion 112 of body 110 contacts the bore 112' of CET'" and, via threads 116 of portion 114, contacts FT. Simultaneously, axial end 118 of portion 112 contacts the axial end face FT' of FT. Additionally, the clamping of CET'" by shoulder 126", as aforesaid, against end face FT' adds a redundant path for the current flow.

Threaded extension 110" has utility for facilitating the connection of additional cable(s) (not shown) to the body 110 and thus to the battery. A butterfly type nut 132 is provided for threaded engagement with extension 110" for securing said cable(s) to the body 110.

In summary, it is to be noted that my terminal connectors are very convenient for attaching cable terminals to side mount-type batteries. The knobs 22 and 122 greatly facilitate the attachment process. The above noted disadvantages of the prior procedure of using wrenches are avoided; for example my connectors can connect and disconnect cable terminals where the illumination is poor.

While the preferred embodiment of the invention has been illustrated, it will be understood that variations may be made by those skilled in the art without departing from the inventive concept. Accordingly, the invention is to be limited only by the scope of the following claims.

What is claimed is:

1. A tool-less, side mount-type battery terminal connector for use in combination with (a) a battery having a top surface, a plurality of sides and a threaded female conductive terminal in one of said sides, and (b) at least one electrical cable having an annular, conductive end terminal with two sides, said battery terminal connector comprising:

(i) an elongated body of conductive metal having a longitudinal axis, an inner end, an outer end and a central cylindrical portion having a pre-selected diameter;

(ii) thread means on said inner end of said body sized for threaded engagement with said female conductive terminal in said side of said automotive type battery, said inner end of said body having a diameter smaller than said pre-selected diameter of said central cylindrical portion of said body, said body having a radially extending shoulder between said inner end and said central cylindrical portion of said body; and (iii) knob means connected to said outer end of said body, said knob means being sized to facilitate manual, tool-less rotation of said body about said longitudinal axis; said connector further including an integral threaded extension of said body projecting longitudinally outward from said outer end of said body.

* * * * *